United States Patent [19]

Beeche

[11] Patent Number: 4,967,875

[45] Date of Patent: Nov. 6, 1990

[54] MODULAR SCAFFOLDING SYSTEM AND CONNECTING JOINTS THEREFOR

[75] Inventor: Gregory L. Beeche, Rexford, N.Y.

[73] Assignee: Garox Corporation, Prior Lake, Minn.

[21] Appl. No.: 861,133

[22] Filed: May 8, 1986

[51] Int. Cl.[5] ..... E04G 3/10; E04G 7/06

[52] U.S. Cl. ..... 182/36; 182/150; 182/179; 52/638

[58] Field of Search ..... 182/179, 178, 142, 36, 182/37, 150, 229; 52/638

[56] References Cited

U.S. PATENT DOCUMENTS

| | | | |
|---|---|---|---|
| 1,060,914 | 5/1913 | Lillow | 182/179 |
| 1,195,488 | 8/1916 | Marshall | 182/179 |
| 3,082,843 | 3/1963 | Leonard | 182/178 |
| 3,190,405 | 6/1965 | Squire | 182/178 |
| 3,204,721 | 9/1965 | Park | 182/178 |
| 3,565,212 | 2/1971 | Johnson | 182/179 |
| 3,684,058 | 8/1972 | Brown | 182/178 |
| 4,078,633 | 3/1978 | Fahy | 182/229 |
| 4,234,055 | 11/1980 | Beeche | 182/63 |
| 4,253,548 | 3/1981 | Beeche | 182/142 |

*Primary Examiner*—Reinaldo P. Machado
*Attorney, Agent, or Firm*—Heslin & Rothenberg

[57] ABSTRACT

A modular scaffolding system includes a plurality of interchangeable structural members, each having a circular cross section. Each member also has a plurality of holes drilled in its outer surface. The holes are located in a pattern that allows flexibility in connecting other structures to the circular member. A number of members are attached together to form a frame, and a scaffold is attached to the frame by appropriate means. The components of the modular scaffolding system may be formed into a variety of configurations, including roof-based and ground-based rolling scaffolds and a trolley-suspended scaffold which moves on a monorail. A moment-arm connecting joint and a pivoting composite connection are provided for connecting the components of the scaffolding system together so that scaffold exhibits a high degree of rigidity, while also providing adjustable angles between predetermined structural members.

35 Claims, 9 Drawing Sheets

MODULAR SCAFFOLDING SYSTEM AND CONNECTING JOINTS THEREFOR

BACKGROUND OF THE INVENTION

This invention relates to scaffolding systems of the type used in building construction and maintenance. More particularly, it relates to a modular scaffolding system that is extremely adaptable for use in a variety of applications, while at the same time having high resistance to structural deformation during loading conditions.

A variety of scaffolding systems have been employed in the past to provide artisans with a suitable area from which to perform their tasks on various portions of buildings or other structures. Such scaffolding systems have been used in tasks ranging from applying siding to buildings under construction to washing the windows of a completed building.

In the past, when a scaffolding system was required for a particular task, the scaffolding would be constructed so that the task involved could be performed on one portion of the building at a time. The constructed scaffolding was typically not moveable from one portion of the building to another. Instead, the scaffolding system frequently required disassembly before being moved, and reassembly after being moved to another portion of the building. For such prior art scaffolding systems, a considerable amount of time and energy is required to dismantle and reassemble the scaffolding each time it is moved. Typically, a plurality of parts of various sizes and shapes must be individually connected and disconnected during assembly and disassembly, respectively, of the scaffold. Furthermore, the workers involved in constructing this type of scaffolding are often at a safety risk, because of the manner in which the work platforms are suspended between the vertical supports. Typically, vertical ladders are provided for holding the ends of the work platforms, and it is necessary for workers to scale these ladders in order to attach the work platforms to the ladders. Another problem which has been encountered in past scaffolding systems is the inability to individually change the levels of the various work platforms without dismantling a substantial portion of the scaffolding.

The scaffolding systems described in U.S. Pat. Nos. 4,234,055 and 4,253,548, issued to G.L. Beeche on Nov. 18, 1980 and Mar. 3, 1981, respectively, alleviate many of the problems associated with prior art scaffolding systems. U.S. Pat. No. 4,234,055 describes a mobile suspension scaffold which requires assembly and dismantling only once for each construction site, at the beginning of the job and at the end of the job, respectively. The scaffolding system disclosed includes a mobile roof vehicle which permits the scaffold to be moved along the sides of a building and around building corners without being disassembled. The scaffold containing the work platforms may be suspended from the roof vehicle and assembled by starting at the top and working downwardly, or it may be assembled by starting at the ground and working upwardly. The scaffold is suspended so that a plurality of work platforms can be disposed at preselected levels through utilization of the suspension system itself. A particularly useful suspended scaffold system is the folding scaffold described in U.S. Pat. No. 4,253,548. The scaffold described therein employs a plurality of work platforms in combination with a chain of foldably linked end support sections disposed in a mechanical relationship which permits the scaffold to be collapsed into a relatively small configuration for storage and transportation, and then unfolded into its erected state at the building site. The work platforms are slidably engaged in the end support sections, and may be raised or lowered independently of raising or lowering the end supports. The individual work platforms are selectively attached to the end support sections at desired levels as the end supports are unfolded, and may also be raised or lowered to different levels while the scaffolding system remains erected.

As the number and variety of scaffolding systems needed for modern-day building construction and maintenance has grown, a problem that has arisen is the requirement imposed by such construction and maintenance of individually tailoring the scaffold to the particular task at hand. Designing and constructing uniquely customized scaffolding systems for every building construction or maintenance project is both time-consuming and relatively expensive. What is needed is a scaffolding system that is adaptable to meet the requirements of a wide variety of applications. The system must also have sufficient rigidity to provide a safe work area for artisans who use the scaffolding and for their materials.

Accordingly, it is an object of the present invention to provide a scaffolding system which is readily adaptable to a wide variety of applications.

It is a further object of the present invention to provide a modular scaffolding system in which a limited number of interchangeable components may be assembled in a wide variety of configurations.

It is another object of the present invention to provide system connecting joints which impart to the scaffolding system high resistance to structural deformation and failure under loading conditions.

It is also an object of the present invention to provide a scaffolding system in which various portions of the building or structure involved may be accessed with minimal dismantling and reassembly of the scaffold.

SUMMARY OF THE INVENTION

In accordance with one aspect of the present invention, a modular scaffolding system comprises a plurality of interchangeable structural members. Each member has a circular cross section of a predetermined diameter. Each member also includes a plurality of cylindrically shaped openings defined in its outer surface at predetermined locations along the length and circumference of the member. The openings are further disposed so that pairs of them are located in diametrically opposed relationship, so that a straight pin, such as a bolt, can be inserted into one opening, through the center of the circular member, and out of another of the openings. A plurality of connecting joints attach predetermined ones of the structural members together to form a frame. Each joint includes fastening means disposed so as to pass through at least one pair of the openings in the structural members. The connecting joints are further configured so that the attached members exhibit high resistance to structural deformation caused by torsional and radial loading forces exerted on the members. The inventive scaffolding system further comprises a scaffold of the type including at least two vertical support columns and a plurality of horizontal work platforms which are configured to be connected to the vertical columns at preselected levels. Also included in the inventive scaffolding system is means for attaching the vertical support columns to the frame of structural members.

In accordance with another aspect of the present invention, structures are provided which exhibit high resistance to structural deformation under loading conditions. A moment-arm connecting joint for attaching a member having a circular cross section to other structural members comprises a backer plate bracket which includes an arcuately shaped surface. The radius of curvature of the surface is substantially equal to the radius of the outer surface of the circularly shaped member, and the bracket is disposed so that its curved surface is adjacent to and at least partially surrounds the outer surface of the circular member. The circular member is fastened to the backer plate bracket so as to produce a force on the member in a direction which is substantially orthogonal to a plane extending in a tangential direction with respect to the curved surface of the bracket. A pivoting composite connection for attaching two structural members together in hinged relationship comprises a male hinge section attached to one of the members and a female hinge section attached to the other of the members. The male section has defined therein a generally cylindrically shaped hinge pin bore which extends throughout the male section. The female section includes a pair of hinge flanges which have cylindrically shaped openings extending therethrough. The flanges are separated by a distance corresponding to the length of the hinge pin bore, and are further disposed so that the longitudinal axis of each flange opening is coaxially located with respect to the longitudinal axis of the bore. A pivot sleeve having the shape of a hollow cylinder is disposed in each flange opening so as to extend through the opening and into the bore. A hinge pin is disposed in the interior of each pivot sleeve, and each pivot sleeve and associated hinge pin are further disposed so that the female hinge section is restrained from lateral movement with respect to the male hinge section, while being rotatable with respect thereto.

DESCRIPTION OF THE DRAWINGS

The subject matter which is regarded as the invention is particularly pointed out and distinctly claimed in the concluding portion of the specification. The invention itself, however, both as to its organization and its method of practice, together with further objects and advantages thereof, may best be understood by reference to the following description taken in conjunction with the accompanying drawings, in which:

FIG. 3 is a similar view of a third embodiment of a scaffolding system constructed in accordance with the present invention;

Figure 8:
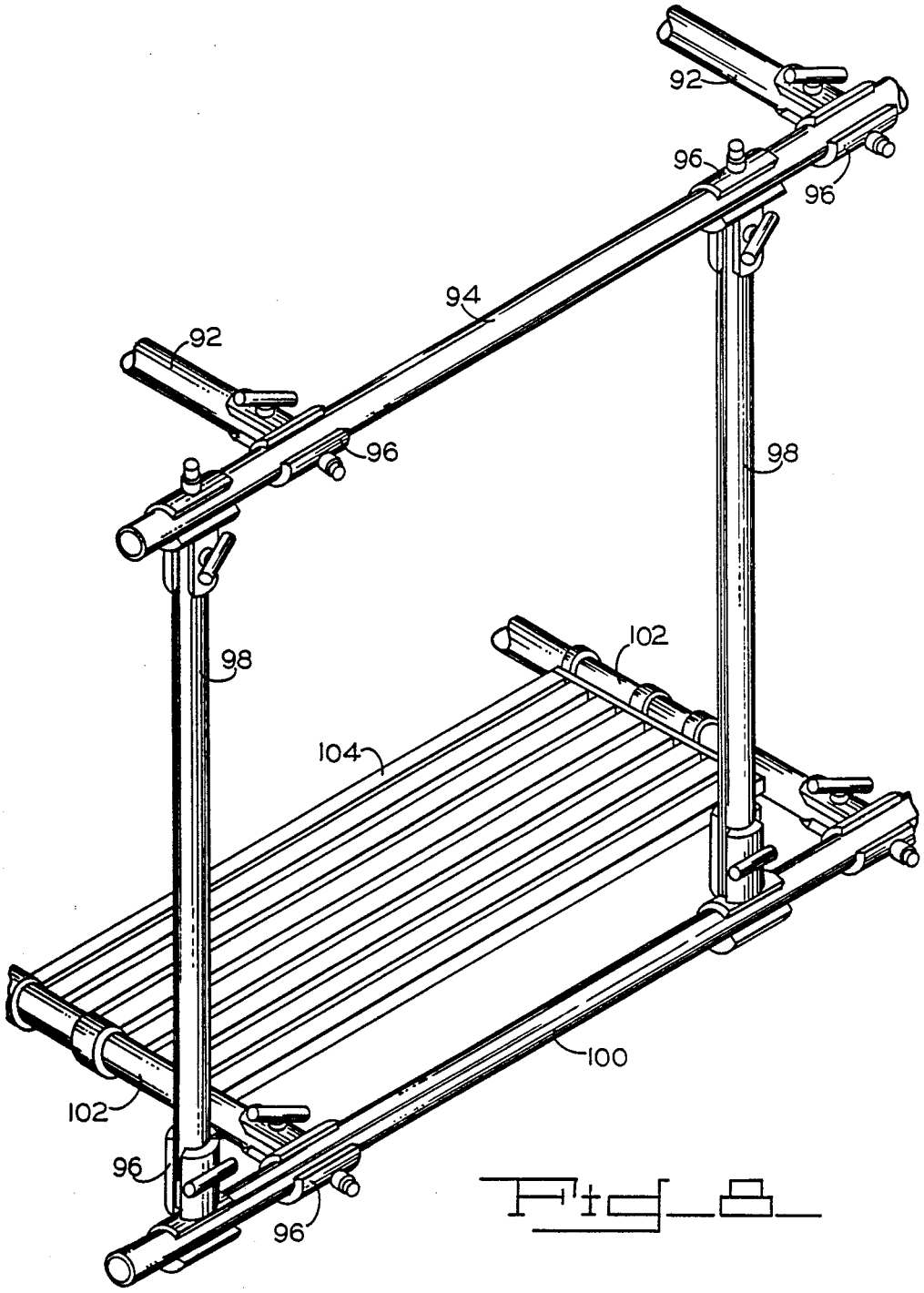
Figure 9:
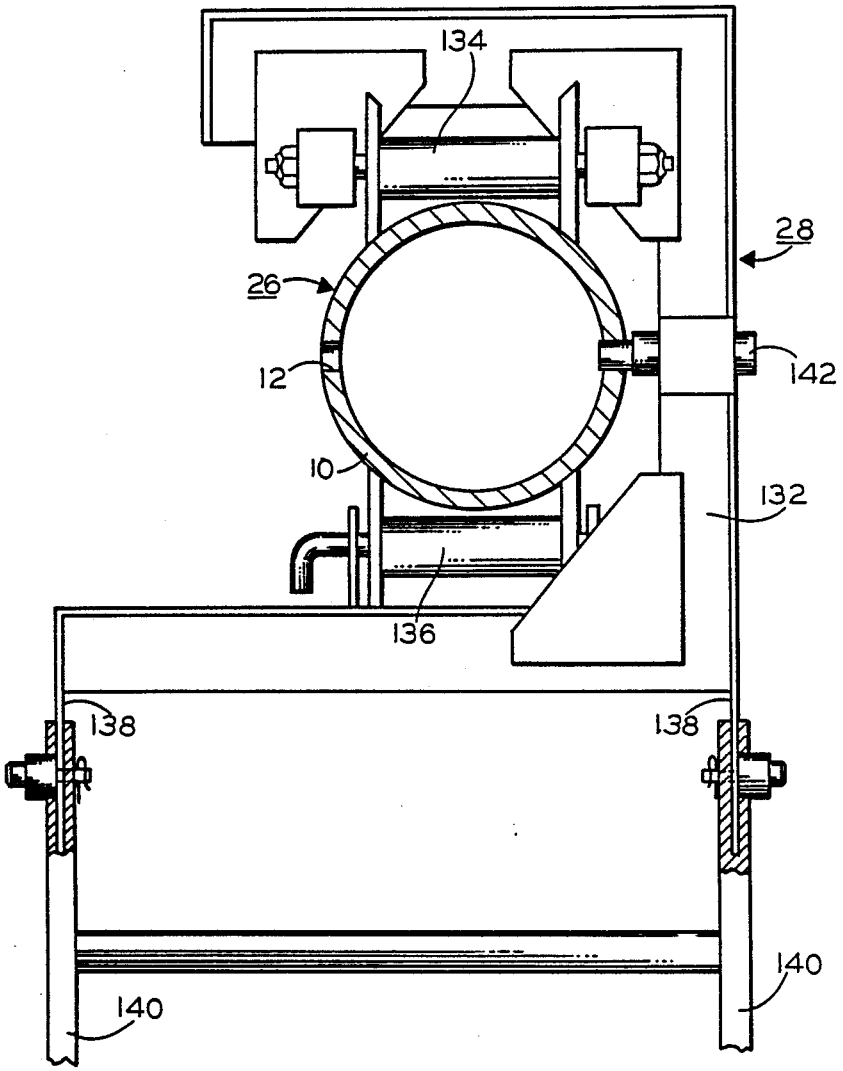
Figure 10:
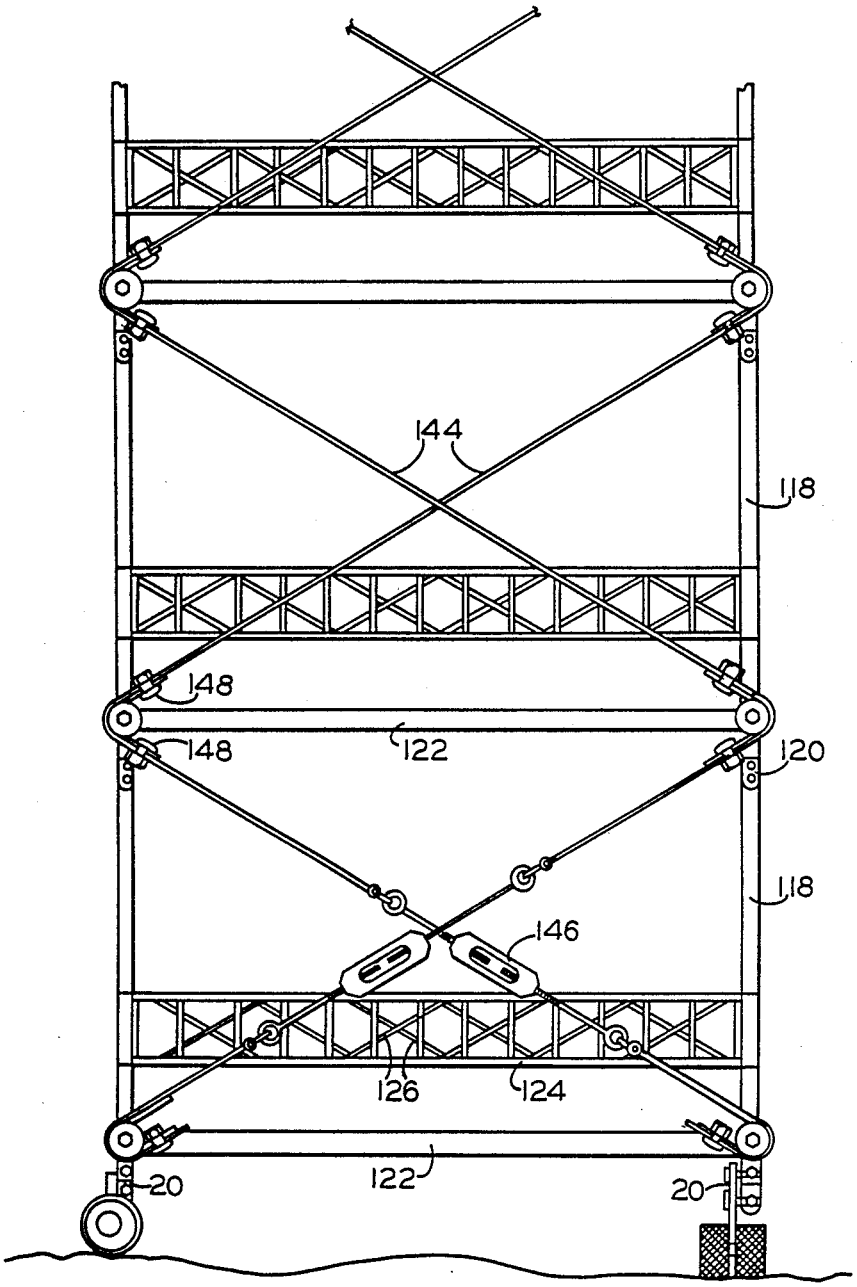
Figure 11B:
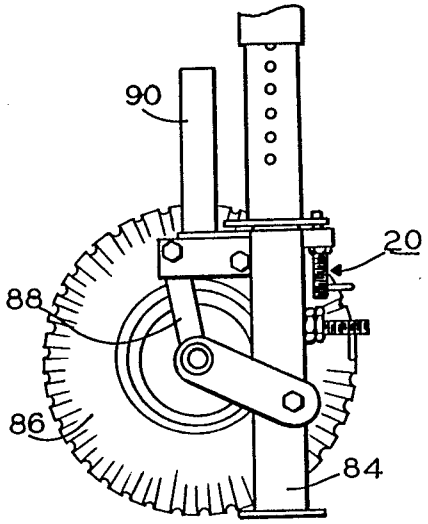
Figure 11A:
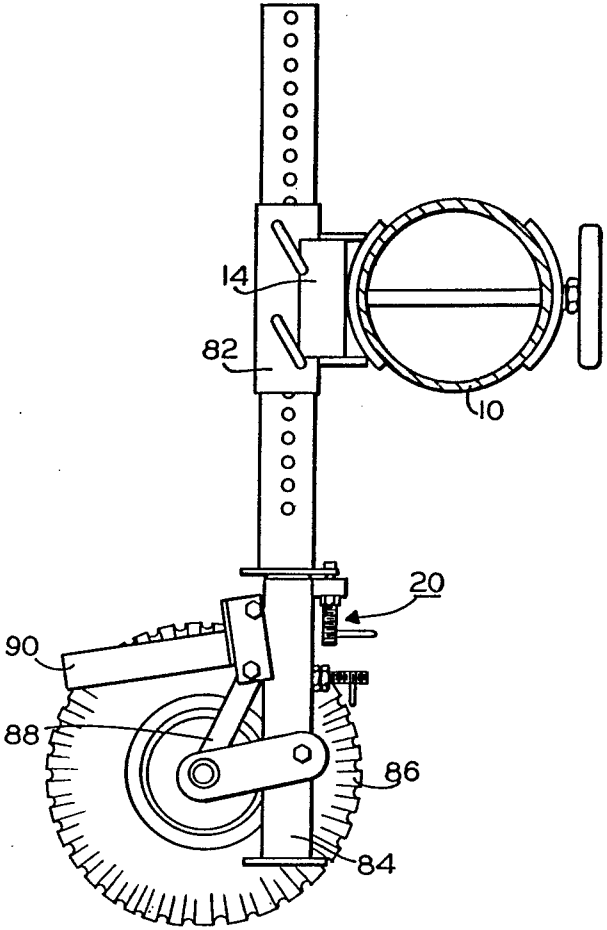

FIGS. *7a*, *7b* , and *7c* are side, end, and top views, respectively, of one embodiment of a scaffold which may be employed in the modular scaffolding system of the present invention;

FIG. 8 is a perspective view of an underslung scaffold constructed in accordance with the present invention;

FIG. 9 is an end elevation, cross-sectional view schematically illustrating one embodiment of a trolley-suspended scaffold in accordance with the present invention;

FIG. 10 is a side elevation view schematically illustrating another embodiment of a scaffold constructed in accordance with the modular scaffolding system of the present invention; and FIGS. 11*a* and 11*b* are side elevational views illustrating one embodiment of an apparatus for selectively positioning a castor wheel with respect to a support pod, showing the scaffold frame being selectively supported by the castor wheel and by the support pod, respectively.

DETAILED DESCRIPTION OF THE PREFERRED EMBODIMENTS

Figure 1:
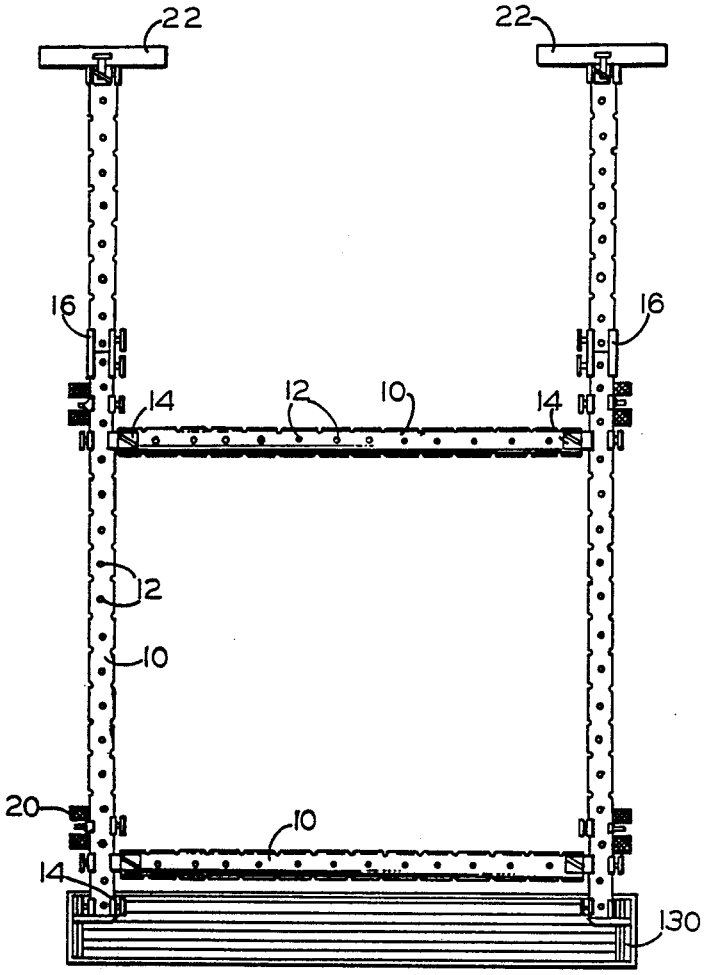
FIG. 1 is a plan view of a first embodiment of a scaffolding system in accordance with the modular concept of the present invention.
Figure 2:
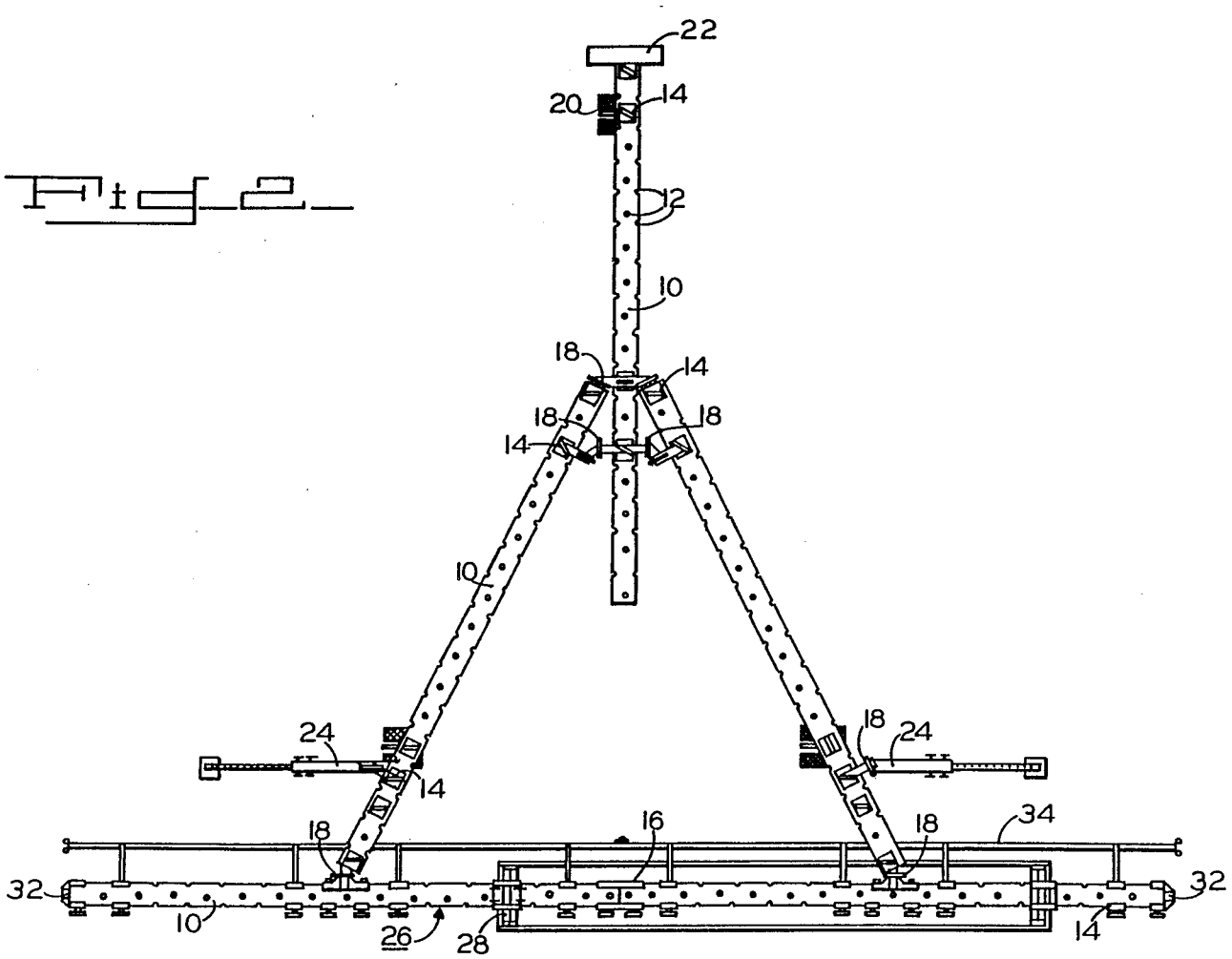
FIG. 2 is a similar view of a second embodiment of a scaffold formed from the modular scaffolding system of the present invention.

FIG. 1 schematically illustrates one embodiment of a scaffold that can be constructed in accordance with the modular scaffolding system of the present invention. Other scaffold arrangements that can be formed using the same modular concept are illustrated in FIGS. 2 and 3. All three of the scaffold arrangements shown may be quickly and easily assembled using the same basic components. In accordance with the present invention, a modular scaffolding system for providing access to various portions of a structure comprises a plurality of interchangeable structural members 10. Members 10 each have a circular cross-section, with all of members 10 having the same predetermined diameter. Preferably, in order to increase the modularity of the scaffolding system, members 10 also have one of a limited number of predetermined standard lengths. For example, the present inventor has found that most scaffolding applications can be accommodated using a combination of members having standard lengths of 8 feet, 16 feet, 24 feet, and 32 feet. Because of the flexibility with which the members of the present invention may be assembled, it is usually not necessary to use any "custom" length members. Each member 10 also has a plurality of cylindrically shaped openings 12 defined in the outer surface thereof. Openings 12 are located at predetermined positions along the length and circumference of each member 10, and are further disposed so that pairs of openings 12 are located in diametrically opposed relationship with respect to the circular cross section of member 10. In the preferred embodiment illustrated in FIG. 2, openings 12 are drilled in member 10 so as to be disposed at one of four predetermined locations around the outer circumference of member 10. For each such circumferential location, openings 12 are disposed along the axial length of member 10 so that the distance between the centers of adjacent openings 12 is one foot. The present inventor has also found it useful to stagger the axial locations of the openings which form an axial row at one circumferential location, with respect to the openings which form an axial row at an adjacent circumferential location. In the embodiment of FIG. 2, four axial rows of openings 12 are equally spaced about the circumference of member 10 so that the rows are located 90 degrees apart from each other. For each axial row of openings 12, the axial locations of one row of openings is staggered with respect to the openings of adjacent rows so that the axial locations of the openings of one row fall midway between the axial locations of the openings of an adjacent row. With openings 12 disposed in this manner, the usable distance between openings effectively becomes six inches rather than one foot, because rotation of the tube by 90 degrees provides two different attachment openings located six inches apart in the axial direction. Staggering openings 12 in this manner also prevents any bolt placement interference that might otherwise occur when attaching other structures or components to diametrically opposed pairs of openings 12. Preferably, openings 12 all have the same diameter, so that bolts having a single diameter may be used to attach other structures to any one or group of openings 12. Also, when members 10 are to be combined in an end-to-end relationship, it is preferable to form openings 12 so that the pattern thereof continues along the entire combined span of the members.

The circular cross-sectional shape of member 10 provides it with uniform strength characteristics in all planes of loading. The principles involved are similar to those which make a semi-circular arch a superior structure for supporting a load which is attached to the center of the arch and directed radially inwardly. In such a configuration, the force exerted on the arch by the load is directed along the circumference of the arch, from the center thereof to the ends. Thus, the bending force produced by the load is converted to compressive forces directed along the length of the arch. For these reasons, a member having a circular cross section effectively includes its own diagonal bracing, thereby providing the member with very high span strength. Such a member also effectively provides its own diaphragm which minimizes twisting movement along the length of the member, thereby imparting it with high torsional rigidity. Of course, the maximum span strength and torsional rigidity for a member having a particular diameter is obtained when the member has a solid interior. However, for applications such as scaffolding, it is desirable to use hollow members in order to save weight and cost. The present inventors have determined that a hollow aluminum tube having an outer diameter of eight inches and a radial thickness of 0.25 inches exhibits sufficient span strength and torsional rigidity to meet the structural requirements of many scaffolding applications. Additionally, tubes of this size can easily be handled by two workers while the scaffolding is being assembled or dismantled. Obviously, if stronger components are needed, members having larger diameters and/or thicknesses may be employed without affecting the principles of this invention.

Each member 10 may be used as a column, a mast, a boom, a truss chord, a simple beam, or a continuous beam. In the modular scaffolding system of the present invention, predetermined ones of members 10 are attached together by a plurality of connecting joints 14 and 16 to form a frame. Each of connecting joints 14 and 16 includes fastening means disposed so as to pass through at least one of the diametrically opposed pairs of openings 12 in structural member 10. Joints 14 and 16 are further configured so that attached members 10 exhibit high resistance to structural deformation caused by torsional and radial loading forces exerted on structural members 10.

As is illustrated in FIGS. 2 and 3, predetermined ones of structural members 10 may also be attached together in hinged relationship by a plurality of pivoting connections 18, so that attached members 10 are adjustable in position with respect to each other. Preferably, each pivoting connection 18 includes fastening means disposed so as to pass through at least one pair of diametrically opposed openings 12 in members 10, and connections 18 are further configured so that the hingedly attached members exhibit high resistance to structural deformation caused by torsional and radial loading forces exerted on members 10. With pivoting connections 18 so configured, the angle between members 10 may be changed while maintaining rigidity in the non-pivoting planes.

Figure 5:
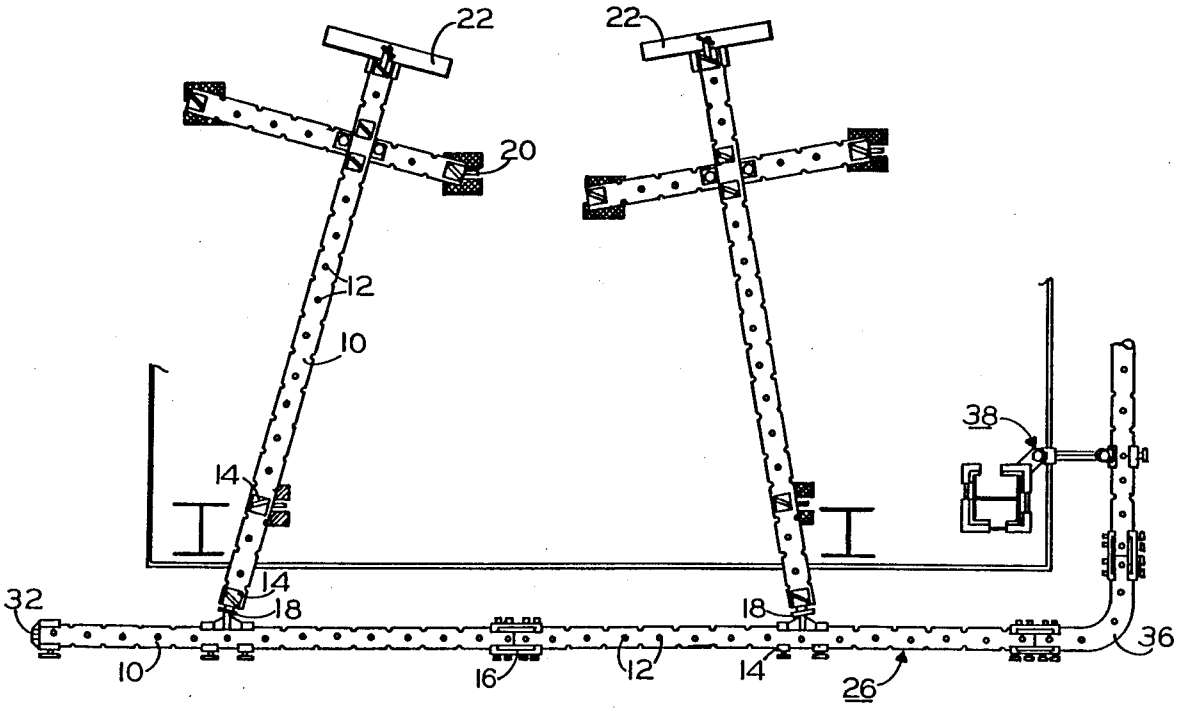
FIG. 5 is a side elevation, partial cross-sectional view of a moment-arm connecting joint, in accordance with another aspect of the present invention.
Figure 4:
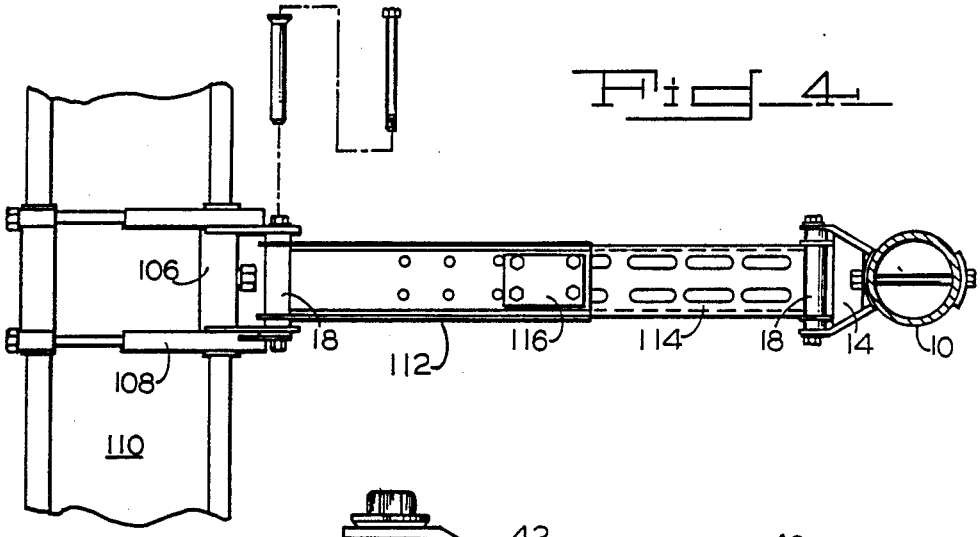
FIG. 4 is a side elevation view in partial cross section of a column support arm for attaching a scaffold monorail to a portion of the structure for which scaffolding is to be provided, in accordance with the present invention.
Figure 5:
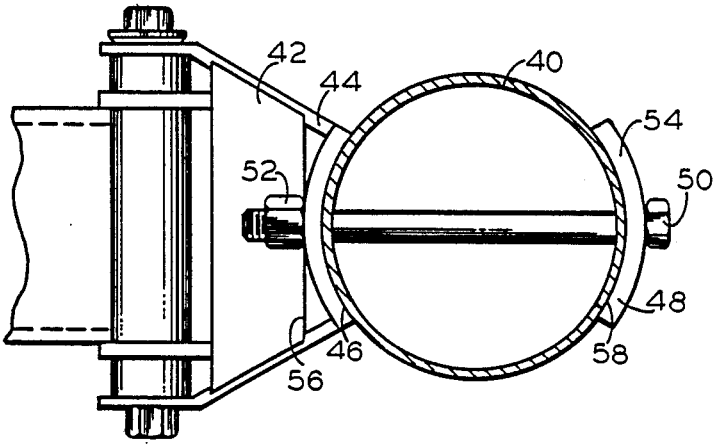

A connecting joint which is especially useful for rigidly attaching members 10 together is schematically illustrated in FIG. 5. As shown therein, a moment-arm arm connecting joint for attaching first structural member 40, having a circularly shaped cross section, to second structural member 42 comprises backer plate bracket 44 attached to second member 42. Bracket 44 includes arcuately shaped surface 46, which surface has a radius of curvature substantially equal to the radius of the outer surface of member 40. Bracket 44 is further disposed so that surface 46 is adjacent to and at least partially surrounds the outer surface of member 40. Backer plate bracket 44 is shown in FIG. 4 as comprising an integral part of structural member 42. However, bracket 44 could also be attached to member 42 by such conventional means as, for example, welds or bolts. The moment-arm connecting joint of the present invention also includes means for fastening member 40 to bracket 44 so as to produce a force on member 40 in a direction which is substantially orthogonal to a plane extending in a tangential direction with respect to arcuately shaped surface 46. Preferably, the fastening means employed is configured to apply an adjustable amount of force on member 40. In the embodiment of FIG. 5, the fastening means comprises at least one bolt 50 extending throughout the diameter of circularly shaped member 40. Bolt 50 is disposed so that the head thereof is adjacent the outer surface of member 40 and so that bolt 50 is fastened to bracket 44 by threaded means attached to bracket 44. The threaded means is threaded to correspond to the threading on bolt 50. In the embodiment illustrated in FIG. 5, the threaded means attached to bracket 44 comprises nut 52. In an alternative embodiment (not shown), bolt 50 is screwed into tapped threads formed in bracket 44. Also, although only one bolt 50 is shown in FIG. 5, more than one such bolt may be employed to fasten member 40 to bracket 44.

For the joint shown in FIG. 5, when a load is exerted on member 40 in a downward direction, the force produced by the load is converted to a tensile force on bolt 50. If curved surface 46 of bracket 44 was absent, so that member 40 was bolted directly to vertical brace 56, loading member 40 with a downward force would produce a force on bolt 50 primarily in the shear direction. Furthermore, without surface 46, tightening bolt 50 would produce a force on member 40 which would tend to crush the outer surface thereof at the point of contact with vertical brace 56. However, when the outer surface of member 40 is fastened to a surface having the same radius of curvature, such as surface 46, a moment arm is produced between the point of fastening and the circumferential ends of arcuately shaped surface 46. Through this moment arm, a force exerted on member 40 in a downward direction is converted to a tensile force on the means which is employed to fasten member 40 to surface 46. The significance of converting the loading force from a shear force to a tensile force is that the tensile strength of many materials is significantly higher than the shear strength thereof. Of course, the longer the circumferential length of surface 46, the larger the moment created. The present inventor has found that, for an aluminum tube having an outer diameter of eight inches and a radial thickness of 0.25 inches, a circumferential length of about six inches for surface 46 provides good results.

In the embodiment illustrated in FIG. 5, the fastening means is disposed so that the force produced thereby on member 40 is exerted at least in part on the outer surface of the portion of member 40 which is diametrically opposed to the portion thereof which is located adjacent to bracket 44. With bolt 50 configured in the manner shown, bolt 50 can be tightened to exert a pre-loading force on the entire cross section of member 40. However, a moment arm could also be created by disposing bolt 50 so that the head thereof is adjacent the inner surface of the portion of member 40 which is mated to surface 46 of bracket 44. Furthermore, although it is preferable, it is not necessary for bolt 50 to pass through the center of the circumferential length of surface 46. Fastening member 40 to surface 46 at any location except the lower circumferential end of surface 46 also produces a moment arm.

In order to prevent the tensile force produced by the fastening means from deforming the outer surface of member 40, it is preferable that the connecting joint of the present invention further comprise means for substantially uniformly distributing the force produced by the fastening means over a predetermined portion of the surface of member 40 upon which the force is exerted. As shown in FIG. 5, in one embodiment the force distributing means comprises washer plate 54. Washer plate 54 includes arcuately shaped washer plate surface 58 which has a radius of curvature substantially equal to the radius of the outer surface of member 40. Washer plate 54 is disposed between the head of bolt 50 and the outer surface of member 40 so that surface 58 is adjacent to the outer surface of member 40, and so that the force exerted on the outer surface of member 40 by the head of bolt 50 is substantially uniformly distributed over the area of the portion of the outer surface of member 40 which is adjacent to surface 58. If desirable, washer plate 54 may be additionally stiffened by a vertical brace configured in the same manner as vertical brace 56 shown in FIG. 5.

Figure 6:
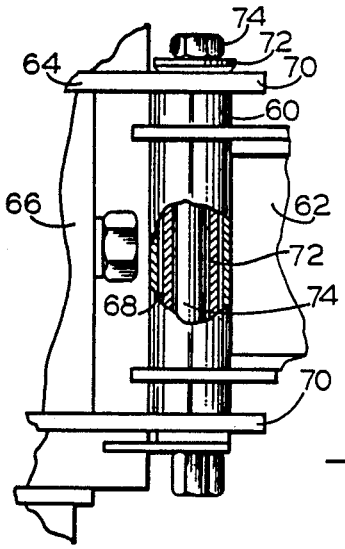
FIG. 6 is a side elevation, partial cross-sectional view of a pivoting composite connection, for connecting two structural members together in accordance with the present invention.

FIG. 6 schematically illustrates a pivoting connection which may be advantageously employed in the modular scaffolding system of the present invention, for attaching two structural members together in hinged relationship. The pivoting composite connection shown therein comprises male hinge section 60 attached to first structural member 62 and female hinge section 64 attached to second structural member 66. Male section 60 has defined therein generally cylindrically shaped hinge pin bore 68 which extends throughout male section 60. Female section 64 includes a pair of hinge flanges 70 which are separated by a distance corresponding to the length of hinge pin bore 68. Each flange 70 has a generally cylindrically shaped opening extending therethrough, which opening is not visible in the view of FIG. 6. Female section 64 is disposed with respect to male section 60, and flanges 70 are further configured, so that the longitudinal axis of the opening in each flange 70 is coaxially located with respect to the longitudinal axis of bore 68. A pivot sleeve 72 having the general shape of a hollow cylinder is disposed in the opening of each flange 70 so as to extend through the flange opening and into bore 68. Generally cylindrically shaped hinge pin 74 is disposed in the interior of each pivot sleeve 72 so that pivot sleeve 72 and associated hinge pin 74 restrain female hinge section 64 from movement with respect to male hinge section 60, in a direction which is perpendicular to the longitudinal axis of bore 68, while simultaneously allowing female section 64 to rotate with respect to male hinge section 60, about the same longitudinal axis.

For a pivoting connection of the type shown in FIG. 6, the maximum shear stress occurs at the interface between male hinge section 60 and flanges 70. By disposing pivot sleeve 72 between hinge pin 74 and the portion of flanges 70 which define the cylindrical openings therein, additional shear resisting material is "laminated" to that of hinge pin 74. In this manner, the shear strength of the composite pivoting connection can be significantly increased without increasing the diameter of hinge pin 74. For the modular scaffolding system of the present invention, the pivoting connection configuration shown in FIG. 6 provides the system with adequate strength while simultaneously allowing the use of hardware which is economical in cost and which can be assembled using conventional tools. Of course, for maximum shear strength, hinge pin 74 comprises a solid cylinder.

For scaffolding applications, hinge pin 74 conveniently comprises a bolt which extends throughout bore 68 and which is fastened to threaded means so as to hold the bolt in position. In the embodiment of FIG. 6, the threaded means comprises a nut located adjacent one of flanges 70. In an alternative embodiment, the bolt is screwed into tapped threads which are formed in flange 70. In yet another embodiment, two separate bolts may be used in place of hinge pin 74, with the two bolts being inserted from opposite ends of pivot sleeve 72 and each bolt being secured to tapped threads formed in the interior of bore 68. Additionally, rather than extending throughout bore 68, pivot sleeve 72 may be separated into two separate pieces which are located at the axial ends of bore 68. In still another embodiment, separate pivot sleeves located at the ends of bore 68 are connected together by an intermediate structure formed from a different material than that used to form the pivot sleeves. In such a configuration, a light weight material which has a relatively low shear strength, such as plastic, may be used advantageously to connect the pivot sleeves.

To maximize the rigidity of the pivoting connection of the present invention, it is preferable that the inner diameter of the opening in each flange 70, the outer diameter of each pivot sleeve 72, and the inner diameter of the portion of bore 68 which contains each pivot sleeve 72 are all sized with respect to each other so as to provide a close mechanical fit between the outer surface of each pivot sleeve 72 and the adjacent inner surfaces of bore 68 and the openings in flanges 70. In one such embodiment, the outer diameter of hinge pin 74 is slightly less than the inner diameter of sleeve 72, and the inner diameter of bore 68 is substantially the same as the inner diameter of the cylindrical opening in each flange 70. To further minimize excess play in the joint, pivot sleeve 72 and associated hinge pin 74 may be configured so that hinge pin 74 restrains pivot sleeve 72 from movement in an axial direction with respect to bore 68. In the embodiment of FIG. 6, pivot sleeve 72 is flared on one end so that, when hinge pin 74 is fastened in place, the flared end of pivot sleeve 72 is clamped between one of flanges 70 and either the head or the nut of the bolt and nut combination which comprises hinge pin 74. Other configurations could also be employed to perform this same function of holding pivot sleeve 72 in position. For example, in some applications it may be desirable to press fit pivot sleeves 72 in position.

As illustrated in FIGS. 1–3 and 10–11, the modular scaffolding system of the present invention may further comprise means for allowing universal rolling motion of the frame of structural members on a supporting surface. This rolling means conveniently comprises a plurality of castors 20 mounted to the frame formed from structural members 10, with castors 20 being disposed so that the frame is rollable on the supporting surface. Preferably, each castor 20 includes fastening means disposed so as to pass through at least one pair of diametrically opposed openings 12 in members 10. Castors 20 may be provided with brakes and may be lockable in predetermined steering angle positions, so that the frame is moveable along a predetermined path. As is better illustrated in FIG. 11*a*, each castor 20 may also include adjusting means 82, for individually adjusting the height between the supporting surface and the structural member 10 to which castor 20 is mounted. Each castor 20 may also include vertical support pod 84 and means for selectively positioning wheel 86 with respect to pod 84 so that, in one position, the weight of the frame is supported by wheel 86, in the manner illustrated in FIG. 11*a*. In another position, the weight of the frame is supported by pod 84, in the manner illustrated in FIG. 11*b*. In the embodiment shown in FIGS. 11*a* and 11*b*, knee jack 88 is configured so that the selective positioning is accomplished by moving lever 90 from a horizontal position to an upright position.

To provide the scaffolding system with additional stability, at least one counterweight may be attached to the frame of structural members 10, in the manner illustrated in FIGS. 1–3 by counterweights 22. Each counterweight 22 is disposed so as to restrain the frame of members 10 from being upended by the force produced thereon by the weight of the scaffolding components attached to the other end of the frame. If a longer moment arm is required for counterweight 22, a telescoping boom may be employed to connect counterweight 22 to the frame, with one end of the boom being attached to one of members 10 and the other end being attached to counterweight 22.

Alternatively to employing counterweight 22, or in combination therewith, at least one outrigger 24 may be employed to provide stability to the scaffolding system. Outrigger 24 is pivotally mounted to the frame of members 10 in hinged relationship so that each outrigger 24 is individually adjustable in position with respect to the frame, in the manner illustrated in FIG. 2. Each outrigger 24 is further disposed so as to provide additional support between the frame and the supporting surface, and so as to restrain the frame from being upended by the force produced thereon by the weight of scaffolding components attached thereto.

The scaffold components described hereinabove form a modular scaffolding system which is readily adaptable to provide a wide variety of scaffold configurations. Interchangeable members 10 are used as building blocks which serve as structural members and as means for attaching and connecting other components. The plurality of openings 12 in members 10 facilitates connecting the members together in virtually any shape or configuration. As examples, frames of members 10 are shown in FIGS. 1, 2, and 3 as having the shape of the letters "H", "Y", and "T", respectively. Members 10 may be attached to each other in an end-to-end relationship by connecting joints 16 in order to produce a continuous span, or at angles to each other by connecting joints 14 and pivoting connections 18. Openings 12 also provide attachment points for accessory components which may be assembled to members 10 in three different planes. Using the moment-arm connecting joint and the pivoting composite connection of the present invention, members 10 may be attached together so as to exhibit structural rigidity in at least two planes. The flexibility of structural member connections and the adjustable angles between the members, associated with the present invention, provides the scaffolding system with the ability to be set up and stabilized in very close proximity to roof or ground obstacles. The inventive support structures usually may be arranged to minimize the span distance between adjacent supports, and the frame of members 10 can be configured to best support the scaffolding load for the application at hand. When the scaffold is to be moved, various frame components may be made to telescope in and out or to swing out of the way, so that the scaffold may be moved around the obstacle involved. Using the adjustable height castors illustrated in FIG. 11*a*, the scaffold frame may be raised to pass over roof-mounted appliances, or the frame may be leveled when the castors are on an uneven surface. Because of the ease with which the inventive scaffolding system may be assembled and disassembled, the scaffolding frame may even be assembled around obstacles such as columns or roof vents for applications having extremely limited access areas, and the frame may be quickly dismantled when it is necessary for the frame to be moved.

The modular scaffolding components of the present invention may be assembled to form ground-based units or roof-based units, and either type of unit may be stationary or mobile. The scaffold may be constructed starting from the ground and working upwardly, or starting from the roof and working downwardly. Cantilevers may be attached to the frame of members 10 in a number of different planes to allow access to wall edges, overhangs such as soffits, and obstacles which prevent edge access on the roof. FIG. 8 schematically illustrates one embodiment of an underslung scaffold in accordance with the present invention, which scaffold may be utilized to gain access to, for example, the soffit area of a building. Support members 92 are attached to a frame of structural members 10 (not shown in FIG. 8), which frame is typically located on the roof of the building. First cross member 94 is rigidly attached to supports 92 by moment-arm connecting joints 96. In a similar manner, vertical supports 98 are attached to first cross member 94, and second cross member 100 is rigidly attached to vertical supports 98. Underslung members 102 are rigidly attached to second cross member 100, again by means of moment-arm connecting joints 96. Work platform 104 is then disposed between underslung supports 102 and is attached thereto by any conventional means. Using the moment-arm connecting joint of the present invention, the type of three-dimensional scaffolding extension illustrated in FIG. 8 can be continued virtually without limit.

FIGS. 2 and 3 illustrate scaffolding systems, constructed in accordance with the present invention, in which predetermined ones of members 10 are attached together to form monorail 26. At least two trolleys 28 are suspended from monorail 26, with trolleys 28 being configured so as to be rollable along the length of monorail 26 while a load is suspended from each trolley 28. End caps 32 are attached to the ends of monorail 26 so as to prevent dolleys 28 from passing beyond the ends of monorail 26. Using connecting joints 16 to connect a plurality of members 10 together in an end-to-end relationship, and means for supporting monorail 26 at appropriate locations along the length thereof, monorail 26 may be extended to run the entire length of the structure to be scaffolded. To provide easy access to the materials needed by artisans using the scaffolding system of the present invention, a separate trolley system may be mounted on materials conveying track 34. Track 34 is rigidly attached to monorail 26 by moment-arm connecting joints 14. Monorail 26 may further include curved sections 36 which are disposed so that monorail 26 follows the contours of the structure for which access is to be provided, as illustrated in FIG. 3.

Monorail 26 ay be supported by a variety of frame configurations, including the H- and Y-shaped frames shown in FIGS. 1 and 2 and the T-shaped frames shown in FIG. 3. Monorail 26 may also be supported by structures attached to the building structure itself, such as, for example, the steel columns of the building is infrastructure. One such supporting structure is column support arm 38 shown in FIG. 3. Column support arm 38 is illustrated in more detail in FIG. 4. As shown therein, each column arm support comprises monorail support bracket 106 attached to one of columns 110. In the embodiment shown in FIG. 4, support bracket 106 is attached to column 110 by means of column clamp 108. For each bracket 106, a corresponding connecting joint is attached to the monorail. Each such connecting joint includes fastening means disposed so as to pass through at least one pair of diametrically opposed openings in structural members 10 which form monorail 26. Preferably, the connecting joint comprises the moment-arm connecting joint of the present invention. Monorail support arm 112 is disposed between monorail support bracket 106 and the associated monorail connecting joint 14. Arm 112 is configured so as to be adjustable in length, by means o sliding portion 114 and retaining plate 116. Pivoting connections 18 are located at opposite ends of arm 112. Pivoting connections 18 are disposed so as to attach the respective ends of arm 112 in hinged relationship to bracket 106 and to connecting joint 114, respectively. Preferably, pivoting connections 18 comprise the pivoting composite connections of the present invention.

The scaffolding system of the present invention further comprises a scaffold of the type including at least two vertical support columns and a plurality of horizonatal work platforms configured to be connected to the vertical support columns at preselected levels. The scaffolding system also includes means for attaching the vertical support columns to the frame formed by structural elements 10.

One embodiment of a scaffold which may be utilized in the present invention is schematically illustrated in FIGS. *7a–7c*. Vertical support columns 118 are attached to the frame of structural elements 10 by attachment points 120. Horizontal work platform 122 is connected at its ends to vertical support columns 118, and is configured so as to be attachable to columns 118 at preselected levels. In the particular embodiment shown in FIG. *7c*, work platform 122 includes trapdoor 128 which provides a safe and convenient means for workers to go from one level of the scaffolding to another. To further improve safety for the workers, the scaffold may include guardrail 124 associated with each work platform 122. Each guardrail 124 is rigidly attached to vertical support columns 118 so as to be disposed generally horizontally between columns 118 at preselected levels. To provide the scaffold with maximum rigidity, it is preferable that columns 118 include diagonal bracing 126, with bracing 126 being disposed so as to effectively transform columns 118 into trusses.

The scaffold may be suspended from the frame of member 10 in the manner illustrated in FIG. 1, or it may be suspended from monorail 26 in the manner illustrated in FIG. 2. When it is suspended from the frame, the scaffold utilized in the present invention may comprise one of the scaffolds described in U.S. Pat. Nos. 4,253,548 and 4,234,055, discussed above and incorporated herein by reference. In one embodiment, the scaffold is suspended from the frame by means of a pair of suspension cable fixtures attached to the frame and by a pair of suspension cables attached to the cable fixtures, with the cables extending downwardly from the cable fixtures through the space to be scaffolded. For this embodiment, the scaffold comprises a pair of chains of vertical support columns, with the vertical columns of each chain being disposed so as to be foldably linked to one another in end-to-end relationship, and with the columns extending substantially vertically along each cable. Attached to the upper end of each chain is means for gripping the associated cable and for selectively moving the chain of columns upwardly or downwardly. The scaffold also includes a plurality of work platforms extending substantially horizontally between the chains of vertical columns, with each platform being moveable vertically with respect to the vertical columns of said chains. The scaffold further comprises means for selectively and individually connecting each work platform to each chain of vertical columns and to its associated cable at preselected levels thereon.

This same type of cable suspension system may be employed to attach the vertical columns of other types of scaffolds to the frame of structural members 10. For these types of scaffolds, the attaching means comprises at least two suspension beam connection fixtures mounted to the frame, and at least two scaffold suspension cables also suspended from the frame. A suspension beam is attached to the vertical support columns so that they are suspended downwardly from the beam. The suspension beam is further disposed so as to be selectively connectable to either the suspension beam connection fixtures or to the scaffold suspension cables.

As an alternative to the cable suspension system just described the vertical support columns of the scaffold may be rigidly attached to the frame of structural members 10, as illustrated in FIG. 1. The scaffold attaching means shown therein comprises at least two connecting joints 14 which rigidly attach vertical columns 130 to predetermined ones of structural members 10. Each joint 14 includes fastening means disposed so as to pass through at least one pair of diametrically opposed openings 12 in members 10.

Yet another means for attaching the vertical columns of the scaffold to the frame of structural members 10 is the monorail and trolley system schematically illustrated in FIG. 9. In a similar manner to the monorail shown in FIG. 2 and 3, monorail 26 is formed from predetermined ones of structural members 10. At least two of trolleys 28 are suspended from monorail 26, so that at least one trolley 28 can be attached to each vertical column. Trolley 28 comprises C-shaped bracket 132 having attached thereto at least one weight-bearing roller 134 and at least one guide roller 136. Rollers 134 and 136 are further disposed so that trolley 28 is rollable along the length of monorail 26 while a load is suspended therefrom. Trolley 28 also includes attachment tabs 138 disposed so that vertical columns 40 of the scaffold may be directly attached thereto. When vertical columns 140 are attached to trolley 28 in the manner illustrated in FIG. 9, the force exerted on trolley 28 by the weight of the scaffolding or by some other moment arm may cause trolley 28 to rotate slightly about the outer surface of monorail 26, especially if the center of gravity of the scaffold is not located directly below the center of monorail 26. For such scaffolding systems, trolley bracket 132 preferably includes a lock pin bore defined therein with the lock pin bore being disposed so that lock pin 142 is insertable through the lock pin bore and into at least one of the plurality of openings 12 in structural members 10. The lock pin bore and lock pin 142 are further disposed so that, when lock pin 142 is inserted into position, trolley 28 is restrained from movement with respect to monorail 26. This restraining force may be further increased by configuring lock pin 142 so that, when it is inserted into position, it extends through the interior of member 10 of monorail 26 and out of the opening 12 which is located in diametrically opposed relationship to the opening 12 which is located adjacent to the hinge pin bore defined in bracket 132.

The vertical support columns of the scaffold may also be attached to trolley 28 by a cable suspension system similar to that described hereinabove in relation to the various types of scaffolds which may be employed in the present invention. When that type of cable suspension system is utilized in the present invention, the scaffold preferably further comprises means for suspending the work platforms from the suspension cables when the platforms are not connected to the vertical columns. The suspending means is further configured so that when a suspension beam is connected to a pair of suspension beam connection fixtures attached either to the frame or to the trolley, the work platforms are moveable vertically with respect to the vertical support columns of the scaffold, by means of the suspension cables.

Figures 7A, 7B, 7C:
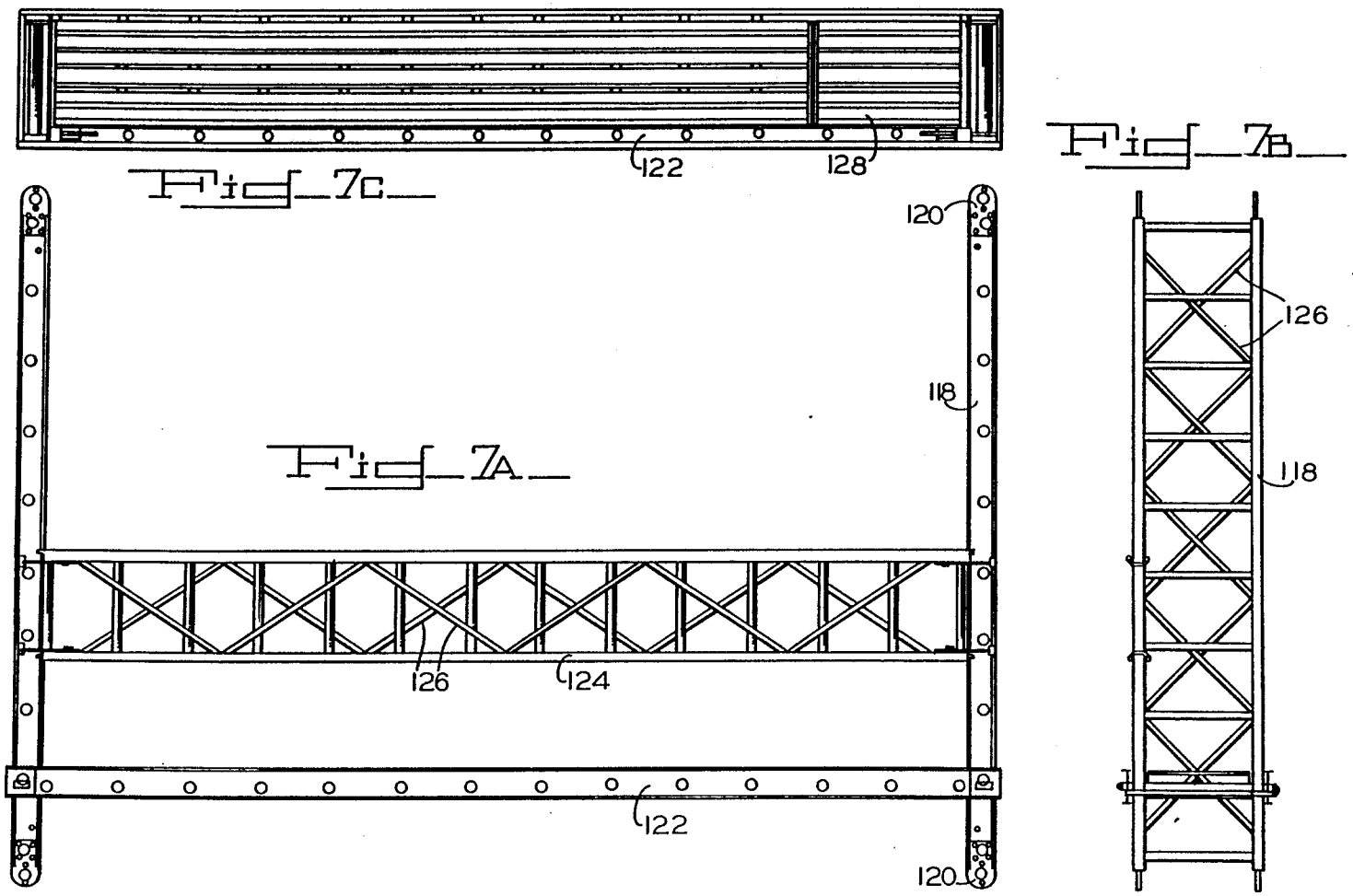

FIG. 10 schematically illustrates a ground-based multi-stage scaffold assembly utilizing the modular scaffolding system of the present invention. A plurality of scaffold stages similar to the scaffold illustrated in FIG. 7*a* are stacked one on top of the other, with the ends of vertical support columns 118 being attached to each other by means of attachment points 120. Although not visible in the view of FIG. 10, structural members 10 are used to form the frame which acts as the base for the scaffold stages. Vertical supports 118 of the bottom scaffold stage are attached to the structural members by the moment-arm connecting joints of the present invention. Steerable casters 20 are also attached to the structural members, with castors 20 being individually adjustable in height so that the scaffold may be leveled when travelling over uneven terrain. The scaffolding system illustrated in FIG. 10 further comprises at least two cables 144 attached to vertical support columns 118. Each cable 144 extends diagonally between the vertical columns of each scaffold stage. The scaffolding system shown also includes means for adjusting the tension on each of cables 144 so as to align vertical columns 118 with a line which is substantially perpendicular to horizontal work platforms 122. In the embodiment of FIG. 10, the tension adjusting means comprises turnbuckle 146. The scaffolding system illustrated therein also includes cable clamps 148 which are attached to vertical columns 118. After the tension on each cable 144 has been adjusted to align vertical columns 118, each cable clamp 148 is tightened so as to secure cables 144 in position with respect to columns 118.

The foregoing describes a modular scaffolding system in which a limited number of interchangeable components may be readily assembled into a wide variety of configurations. The flexibility afforded by the modular scaffolding system of the present invention allows erection of a scaffold for nearly any structure, with very few or no custom made components being required. The scaffolding system is easily adaptable to a wide variety of applications, including construction and maintenance on such diverse structures as private homes, skyscrapers, amusement park equipment, and oil drilling rigs. The present invention also provides connecting joints which exhibit high resistance to structural deformation and failure under loading conditions. These joints are especially useful in attaching the various components of the scaffolding system together in a rigid fashion. Furthermore, the scaffolding system of the present invention provides access to various portions of the building or structure involved with minimal dismantling and reassembly of the scaffold.

While the invention has been described in detail herein in accord with certain preferred embodiments thereof, many modifications and changes therein may be effected by those skilled in the art. For example, while many of the components of the scaffolding system have been shown in the Figures as comprising metal, other materials having sufficient mechanical strength for the application involved may also be used. Accordingly, it is intended by the appended claims to cover all such modifications and changes as fall within the true spirit and scope of the invention.

THE INVENTION CLAIMED IS:

1. A modular scaffolding system for providing access to various portions of a structure, said system comprising:

a plurality of interchangeable structural members each having a circular cross section of a predetermined diameter, each said member also having a plurality of cylindrically shaped openings defined in the outer surface thereof at predetermined locations along the length and circumference of said member, with said openings being further disposed so that pairs of said openings are located in diametrically opposed relationship with respect to said circular cross section;

a plurality of connecting joints which attach predetermined ones of said structural members together to form a frame, each said joint including fastening means disposed so as to pass through at least one of said pairs of openings in said structural members, said joints being further configured so that said attached members exhibit high resistance to structural deformation caused by torsional and radial loading forces on said structural members;

a scaffold of the type including at least two vertical support columns and a plurality of horizontal work platforms configured to be connected to said vertical support columns at preselected levels; and means for attaching said vertical support columns to said frame of structural members.

2. The system of claim 1 wherein each said connecting joint comprises:

a backer plate bracket which includes an arcuately shaped surface having a radius of curvature substantially equal to the radius of the outer surface of said circularly shaped structural members, said bracket being further disposed so that said arcuately shaped surface is adjacent to and at least partially surrounds the outer surface of one of said members; and means for fastening said adjacent structural member to said backer plate bracket so as to produce a force on said member in a direction which is substantially orthogonal to a plane extending in a tangential direction with respect to said arcuately shaped surface of said bracket.

3. The system of claim 1 further comprising a plurality of pivoting connections which attach predetermined ones of said structural members together in hinged relationship so that said predetermined members are adjustable in position with respect to each other.

4. The system of claim 3 wherein each said pivoting connection includes fastening means disposed so as to pass through at least one of said pairs of openings in said structural members, said pivoting connections being further configured so that the hingedly attached members exhibit high resistance to structural deformation caused by torsional and radial loading forces on said members.

5. The system of claim 3 wherein each said pivoting connection comprises:

a male hinge section attached to one of said members, said male hinge section having defined therein a generally cylindrically shaped hinge pin bore which extends throughout said male hinge section;

a female hinge section attached to another one of said members, said female hinge section including a pair of hinge flanges separated by a distance corresponding to the length of said hinge pin bore, each of said flanges having a generally cylindrically shaped opening extending therethrough, said female hinge section being disposed with respect to said male hinge section, and said flanges and said openings being further configured, so that the longitudinal axis of each said opening is coaxially located with respect to the longitudinal axis of said bore;

a pivot sleeve disposed in each said flange opening so as to extend through said opening and into said bore, each said pivot sleeve having the general shape of a hollow cylinder; and a generally cylindrically shaped hinge pin disposed in the interior of each said pivot sleeve, each said pivot sleeve and associated hinge pin being further disposed so that said female hinge section is restrained from movement with respect to said male hinge section in a direction which is perpendicular to the longitudinal axis of said bore, while simultaneously being rotatable about said longitudinal axis with respect to said male hinge section.

6. The system of claim 1 further comprising means for allowing universal rolling motion of said frame of structural members on a supporting surface.

7. The system of claim 6 wherein said rolling means comprises a plurality of castors mounted to said frame of structural members so that said frame is rollable on said supporting surface.

8. The system of claim 7 wherein each said castor includes fastening means disposed so as to pass through at least one of said pairs of openings in said structural members.

9. The system of claim 7 wherein each said castor includes means for individually adjusting the height between said supporting surface and the structural member of said frame to which said castor is mounted.

10. The system of claim 7 wherein said castors are provided with brakes and are lockable in predetermined steering angle positions.

11. The system of claim 7 wherein each said castor includes at least one wheel, a vertical support pod, and means for selectively positioning said wheel with respect to said pod so that, in one position, said frame is supported on said supporting surface by said wheel, and in another position, said frame is supported on said surface by said pod.

12. The system of claim 6 further comprising at least one counterweight attached to said frame of structural members, each said counterweight being disposed so as to restrain said frame from being upended by the force produced thereon by the weight of said scaffold.

13. The system of claim 6 further comprising at least one outrigger pivotally mounted to said frame in hinged relationship so that each said outrigger is individually adjustable in position with respect to said frame, each said outrigger being further disposed so as to provide additional support between said frame and said supporting surface and so as to restrain said frame from being upended by the force produced thereon by the weight of said scaffold.

14. The system of claim 1 wherein said means for attaching said vertical support columns to said frame comprises at least two connecting joints which rigidly attach said columns to predetermined ones of said structural members, each said joint including fastening means disposed so as to pass through at least one of said pairs of openings in said structural members.

15. The system of claim 1 wherein said scaffold is suspended from said frame and wherein said means for attaching said vertical support columns to said frame comprises:

at least two suspension beam connection fixtures mounted to said frame;

at least two scaffold suspension cables also suspended from said frame; and a suspension beam attached to said vertical support columns so that said columns are suspended downwardly from said beam, said beam being further disposed so as to be selectively connectable to said suspension beam connection fixtures and said scaffold suspension cables.

16. The system of claim 15 wherein said scaffold further comprises means for suspending said work platforms from said suspension cables when said platforms are not connected to said vertical columns, so that, when said suspension beam is connected to said suspension beam connection fixtures, said platforms are moveable vertically with respect to said columns and to said suspension beam, by means of said cables.

17. The system of claim 1 wherein said scaffold is suspended from said frame and wherein said means for attaching said vertical columns to said frame comprises:

a monorail formed from predetermined ones of said structural members which are attached together to form a frame;

at least two trolleys suspended from said monorail, said trolleys being configured so as to be rollable along the length of said monorail while a load is suspended from each said trolley; and means for fastening said vertical columns to said trolleys.

18. The system of claim 17 wherein said means for fastening said vertical columns to said trolleys comprises:

at least two suspension beam connection fixtures mounted to said trolley;

at least two scaffold suspension cables suspended from said trolley; and a suspension beam attached to said vertical columns so that said columns are suspended from said beam, said beam being further disposed so as to be selectively connectable to said suspension beam connection fixtures and to said scaffold suspension cables.

19. The system of claim 18 wherein said scaffold further comprises means for suspending said work platforms from said suspension cables when said platforms are not connected to said vertical columns, so that, when said suspension beam is connected to said connection fixtures, said platforms are moveable vertically with respect to said columns and to said suspension beam, by means of said cables.

20. The system of claim 17 wherein each said trolley has a lock pin bore defined therein, said lock pin bore being disposed so that a lock pin is insertable therethrough and into at least one of said plurality of openings in said structural members that form said monorail, and so that, when said lock pin is inserted therein, said trolley is restrained from movement with respect to said monorail.

21. The system of claim 17 further comprising means for rigidly affixing said monorail to one or more components of the structure for which access is to be provided.

22. The system of claim 21 wherein said affixing means comprises:

a plurality of monorail support brackets, disposed so that one of said brackets is attached to each of said one or more components;

a plurality of connecting joints attached to said monorail, with the number of connecting joints corresponding to the number of said support brackets, each said joint including fastening means disposed so as to pass through at least one of said pairs of openings in said structural members which form said monorail;

a monorail support arm disposed between each said monorail support bracket and the associated monorail connecting joint, each said arm being configured so as to be adjustable in length; and a pair of pivoting connections located at opposite ends of said arm, said pivoting connections being disposed so as to attach the respective ends of said arm in hinged relationship to one of said brackets and to one of said connecting joints.

23. The system of claim 22 wherein each said connecting joint comprises:

a backer plate bracket attached to the adjacent pivoting connection, said bracket including an arcuately shaped surface having a radius of curvature substantially equal to the radius of the outer surface of said members which form said monorail, said bracket being further disposed so that said arcuately shaped surface is adjacent to and at least partially surrounds the outer surface of said monorail member; and means for fastening said monorail member to said backer plate bracket so as to produce a force on said monorail member in a direction which is substantially orthogonal to a plane extending in a tangential direction with respect to said arcuately shaped surface of said bracket.

24. The system of claim 22 wherein said pair of pivoting connections comprises:

a male hinge section attached to each end of said arm, each said male hinge section having defined therein a generally cylindrically shaped hinge pin bore which extends throughout said male hinge section;

a pair of female hinge sections attached, respectively, to said monorail support bracket and to said monorail connecting joint, each said female hinge section including a pair of hinge flanges separated by a distance corresponding to the length of said hinge pin bore, each of said flanges having a generally cylindrically shaped opening extending therethrough, each said female hinge section being disposed with respect to the associated male hinge section so that the longitudinal axis of each flange opening is coaxially located with respect to the longitudinal axis of the associated hinge pin bore;

a pivot sleeve disposed in each said flange opening so as to extend through said opening and into said associated hinge pin bore, each said pivot sleeve having the general shape of a hollow cylinder; and a generally cylindrically shaped hinge pin disposed in the interior of each said pivot sleeve, each said pivot sleeve and associated hinge pin being further disposed so that said female hinge section is restrained from movement with respect to said male hinge section in a direction which is perpendicular to the longitudinal axis of said bore, while simultaneously being rotatable about said longitudinal axis with respect to said male hinge section.

25. The system of claim 17 wherein said monorail includes curved sections which are disposed so that said monorail follows the contours of the structure for which access is to be provided.

26. The system of claim 1 wherein said scaffold is suspended from said frame, wherein said means for attaching said vertical support columns to said frame comprises a pair of suspension cable fixtures attached to said frame and a pair of suspension cables attached to said cable fixtures, said cables extending downwardly from said fixtures through the space to be scaffolded, and wherein said scaffold comprises:

a pair of chains of vertical support columns, said vertical columns of each chain being disposed so as to be foldably linked to one another in an end-to-end relationship and so as to extend substantially vertical along each cable;

means attached to the upper end of each chain for gripping its associated cable and selectively moving the chain of columns upwardly and downwardly thereon;

a plurality of work platforms extending substantially horizontally between the chains of vertical columns, each said platform being moveable vertically with respect to the vertical columns of said chains; and means for selectively and individually connecting each work platform to each chain of vertical columns and to its associated cable, at preselected levels thereon.

27. The system of claim 1 wherein said scaffold further comprises a guardrail associated with each said work platform, each said guardrail being rigidly attached to said vertical support columns at preselected levels so as to be disposed generally horizontally between said vertical support columns.

28. The system of claim 1 wherein said scaffold further comprises:

at least two cables attached to said vertical columns, each said cable extending diagonally therebetween; and means for adjusting the tension on each of said cables so as to align said vertical columns with a line which is substantially perpendicular to said horizontal work platforms.

29. A pivoting composite connection for attaching two structural members together in hinged relationship, said connection comprising:

a male hinge section attached to one of said structural members, said male hinge section having defined therein a generally cylindrically shaped hinge pin bore which extends throughout said male hinge section;

a female hinge section attached to the other one of said two structural members, said female hinge section including a pair of hinge flanges separated by a distance corresponding to the length of said hinge pin bore, each of said flanges having a generally cylindrically shaped opening extending therethrough, said female hinge section being disposed with respect to said male hinge section, and said flanges and said openings being further configured, so that the longitudinal axis of each said opening is coaxially located with respect to the longitudinal axis of said bore;

a pivot sleeve disposed in each said flange opening so as to extend through said opening and into said bore, each said pivot sleeve having the general shape of a hollow cylinder; and a generally cylindrically shaped hinge pin disposed in the interior of each said pivot sleeve, each said pivot sleeve and associated hinge pin being further disposed so that said female hinge section is restrained from movement with respect to said male hinge section in a direction which is perpendicular to the longitudinal axis of said bore, while simultaneously being rotatable about said longitudinal axis with respect to said male hinge section.

30. The connection of claim 29 wherein said pivot sleeves disposed in said flange openings are connected together to form a unitary structure extending throughout said bore.

31. The connection of claim 29 wherein the inner diameter of each said flange opening, the outer diameter of each said pivot sleeve, and the inner diameter of the portion of said hinge pin bore containing each said pivot sleeve are all sized with respect to each other so as to provide a close mechanical fit between the outer surface of each said pivot sleeve and the adjacent inner surfaces of said bore and said flange openings.

32. The connection of claim 29 wherein each said pivot sleeve and associated hinge pin are further configured so that said hinge pin restrains said pivot sleeve from movement in an axial direction with respect to said cylindrically shaped bore.

33. The connection of claim 32 wherein each said hinge pin comprises a bolt.

34. Apparatus for rigidly affixing a scaffolding member to one or more components of the structure for which the scaffolding is to provide access, said apparatus comprising:

a plurality of support brackets, disposed so that one of said brackets is attached to each of said one or more components;

a plurality of connecting joints attached to said scaffolding member ,with the number of connecting joints corresponding to the number of said support brackets;

a support arm disposed between each said support bracket and the associated connecting joint, each said arm being configured so as to be adjustable in length;

a male hinge section attached to each end of said arm, each said male hinge section having defined therein a generally cylindrically shaped hinge pin bore which extends throughout said male hinge section;

a pair of female hinge sections attached, respectively, to said support bracket and to said connecting joint, each said female hinge section including a pair of hinge flanges separated by a distance corresponding to the length of said hinge pin bore, each of said flanges having a generally cylindrically shaped opening extending therethrough, each said female hinge section being disposed with respect to the associated male hinge section so that the longitudinal axis of each flange opening is coaxially located with respect to the longitudinal axis of the associated hinge pin bore;

a pivot sleeve disposed in each said flange opening so as to extend through said opening and into said associated hinge pin bore, each said pivot sleeve having the general shape of a hollow cylinder; and a generally cylindrically shaped hinge pin disposed in the interior of each said pivot sleeve, each said pivot sleeve and associated hinge pin being further disposed so that said female hinge section is restrained from movement with respect to said male hinge section in a direction which is perpendicular to the longitudinal axis of said bore, while simultaneously being rotatable about said longitudinal axis with respect to said male hinge section.

35. The apparatus of claim 34 wherein said scaffolding member comprises a monorail having a circular cross section, and wherein each said connecting joint comprises:

a backer plate bracket attached to the adjacent pivoting connections aid bracket including an arcuately shaped surface having a radius of curvature substantially equal to the radius of the outer surface of said monorail, said bracket being further disposed so that said arcuately shaped surface is adjacent to and at least partially surrounds the outer surface of said monorail member; and means for fastening said monorail member to said backer plate bracket so as to produce a force on said monorail member in a direction which is substantially orthogonal to a plane extending in a tangential direction with respect to said arcuately shaped surface of said bracket.

* * * * *

UNITED STATES PATENT AND TRADEMARK OFFICE

CERTIFICATE OF CORRECTION

PATENT NO. : 4,967,875

DATED : November 6, 1990

INVENTOR(S) : Gregory L. Beeche

It is certified that error appears in the above-identified patent and that said Letters Patent is hereby corrected as shown below:

On the title page:
In the Abstract, line 15, insert --the-- after "that";

Column 4, line 19, substitute --elevation-- for "elevational";

Column 11, line 27, substitute --may-- for "ay";

line 32, substitute --building's-- for "building is";

line 50, substitute --of-- for "o";

Column 20, line 55, substitute --connection, said-- for "connections aid".

Signed and Sealed this

Third Day of March, 1992

*Attest:*

HARRY F. MANBECK, JR.

*Attesting Officer*

*Commissioner of Patents and Trademarks*